US007464669B2

(12) United States Patent
Maryamchik et al.

(10) Patent No.: US 7,464,669 B2
(45) Date of Patent: Dec. 16, 2008

(54) INTEGRATED FLUIDIZED BED ASH COOLER

(75) Inventors: Mikhail Maryamchik, Fairlawn, OH (US); Michael J. Szmania, Medina, OH (US); David E. James, Barberton, OH (US); David J. Walker, Wadsworth, OH (US); Donald L. Wietzke, Carlsbad, CA (US)

(73) Assignee: Babcock & Wilcox Power Generation Group, Inc.

( * ) Notice: Subject to any disclaimer, the term of this patent is extended or adjusted under 35 U.S.C. 154(b) by 94 days.

(21) Appl. No.: 11/406,765

(22) Filed: Apr. 19, 2006

(65) Prior Publication Data

US 2007/0283902 A1 Dec. 13, 2007

(51) Int. Cl.
*F23C 10/24* (2006.01)

(52) U.S. Cl. ..... 122/4 D; 432/80; 422/139

(58) Field of Classification Search ..... 122/4 D; 432/58, 77–80; 110/243, 244, 245; 422/139, 422/143; 423/215.5
See application file for complete search history.

(56) References Cited

U.S. PATENT DOCUMENTS 4,453,495 A * 6/1984 Strohmeyer, Jr. ..... 122/4 D
4,464,183 A * 8/1984 Arisaki ..... 122/7 R
4,960,057 A * 10/1990 Ohshita et al. ..... 110/245
5,013,336 A * 5/1991 Kempf et al. ..... 423/245.1
5,095,854 A * 3/1992 Dietz ..... 122/4 D
5,218,932 A * 6/1993 Abdulally ..... 122/4 D
5,372,791 A * 12/1994 Abdulally ..... 422/139
5,390,612 A * 2/1995 Toth ..... 110/245
5,476,639 A * 12/1995 Hyppanen ..... 122/4 D
5,526,938 A * 6/1996 Kraft et al. ..... 209/139.1
5,540,894 A * 7/1996 Hyppanen ..... 122/4 D
5,546,875 A * 8/1996 Selle et al. ..... 110/245
6,418,866 B1 * 7/2002 Shimizu et al. ..... 110/243

* cited by examiner

*Primary Examiner*—Gregory A Wilson
(74) *Attorney, Agent, or Firm*—Eric Marich; Michael J. Seymour

(57) ABSTRACT

An integrated fluidized bed ash cooler for a fluidized bed boiler, particularly a circulating fluidized bed (CFB) boiler, employs at least two fluidized bed sections positioned in series along a solids flow path. Each section contains fluidizing means, the first section along the solids path being separated from a following section with a threshold. The first section contains means for measuring a bed temperature in the vicinity of the fluidizing means and at a higher elevation within the fluidized bed. Means are provided for removing oversized bed material from the first section to facilitate the removal of ash while minimizing the possibility of ash plugging during operation.

13 Claims, 7 Drawing Sheets

INTEGRATED FLUIDIZED BED ASH COOLER

FIELD OF THE INVENTION

The present invention relates, in general, to fluidized bed ash coolers and, more particularly, to an integrated fluidized bed ash cooler which facilitates the removal of ash while minimizing the possibility of ash plugging during operation.

BACKGROUND OF THE INVENTION

Fluidized bed bottom ash coolers are widely used in fluidized bed combustion technology. The bottom ash removed from fluidized bed combustors contains a significant amount of heat. Removal of the heat in the bottom ash reduces the temperature of the ash, thereby facilitating handling and disposal of same. Recovery of the heat in the bottom ash is also desirable in order to enhance the overall thermal efficiency of the fluidized bed combustion plant. Fluidization of the ash in the ash cooler sharply enhances heat transfer between the ash and the cooling medium which allows for the size of the ash cooler to be reduced.

Typical existing prior art fluidized bed bottom ash coolers for a circulating fluidized bed (CFB) boiler are shown in FIGS. 1, 2, 3 and 4. FIGS. 1 and 2 illustrate a typical fluidized bed bottom ash cooler 10 which is provided within a refractory-lined box or enclosure and supported off of boiler structural steel. In certain circumstances, and as illustrated in FIGS. 3 and 4, the ash cooler 10 is provided within a fluid-cooled (typically water and/or steam-cooled) enclosure formed of membrane tube wall panels. In both types of fluidized bed ash cooler 10 designs, the fluidized bed ash cooler 10 is still a structure separate from the CFB furnace 20, and separately supported off of the boiler structural steel. As shown in FIGS. 1-4, ash for cooling is transferred from the CFB furnace 20 to the fluidized bed ash cooler 10 via an air-assisted conduit 30 connected between the CFB furnace 20 and a lower part of the ash cooler 10. The ash is fluidized within the ash cooler 10, typically with fluidization air supplied through the bottom of the enclosure surrounding the ash cooler 10, whether refractory-lined or water-cooled. Cooling of the ash within the ash cooler 10 takes place through heat exchange between the (relatively) cold air provided for fluidization and the hot ash. The heated air is then conveyed back to the CFB furnace 20 via a conduit 40 connected to an upper part of the ash cooler 10. Cooled ash is discharged via a drain (not shown) at the bottom of the ash cooler 10. The ash cooler 10 may include heat absorbing surface, typically water-cooled tube banks 50, placed within the fluidized ash bed established within the ash cooler 10. In such a case, a bulk of the heat from the hot bottom ash transferred from the CFB furnace 20 into the ash cooler 10 would be absorbed by the cooling water circulated through the water-cooled tube banks 50 with the air provided into the ash cooler 10 primarily playing the role of the fluidizing medium.

While the existing ash coolers provide necessary ash cooling and enhance boiler efficiency by returning the heat absorbed from the ash back to the boiler system, the existing ash coolers have several shortcomings including: a complicated support structure, the need for high-temperature expansion joints to accommodate differences in thermal expansion between the ash cooler and the furnace, and complexity of solids transfer from the furnace to the ash cooler.

SUMMARY OF THE INVENTION

The present invention overcomes such shortcomings, and provides other advantages, while simultaneously allowing for reductions in the size, weight and cost of the ash cooler.

Accordingly, one aspect of the present invention is drawn to a fluidized bed ash cooler for cooling bottom ash solids from a fluidized bed furnace. The fluidized bed ash cooler comprises at least two fluidized bed sections positioned in series along a solids flow path, each section containing fluidizing means. The first section along the solids path is separated from a following section with a threshold, the first section containing means for measuring a bed temperature in the vicinity of the fluidizing means and at a higher elevation within the fluidized bed. Means are also provided for removing oversized bed material from the first section.

Another aspect of the invention is drawn to the combination of a fluidized bed furnace having enclosure walls and a fluidized bed ash cooler for cooling bottom ash solids from the fluidized bed furnace, the fluidized bed furnace and the ash cooler sharing a common wall with each other. In this combination, the fluidized bed ash cooler comprises at least two fluidized bed sections positioned in series along a solids flow path, each section containing fluidizing means. The first section along the solids path is separated from a following section with a threshold, the first section containing means for measuring the solids temperature in the vicinity of the fluidizing means and at a higher elevation within the fluidized bed. Means are provided for removing oversized bed material from the first section.

Yet another aspect of the invention is to provide an integrated fluidized bed ash cooler which is simple in design, rugged in construction and economical to manufacture.

The various features of novelty which characterize the invention are pointed out with particularity in the claims annexed to and forming part of this disclosure. For a better understanding of the present invention, and the operating advantages attained by its use, reference is made to the accompanying drawings and descriptive matter, forming a part of this disclosure, in which a preferred embodiment of the invention is illustrated.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENT

Figure 1:
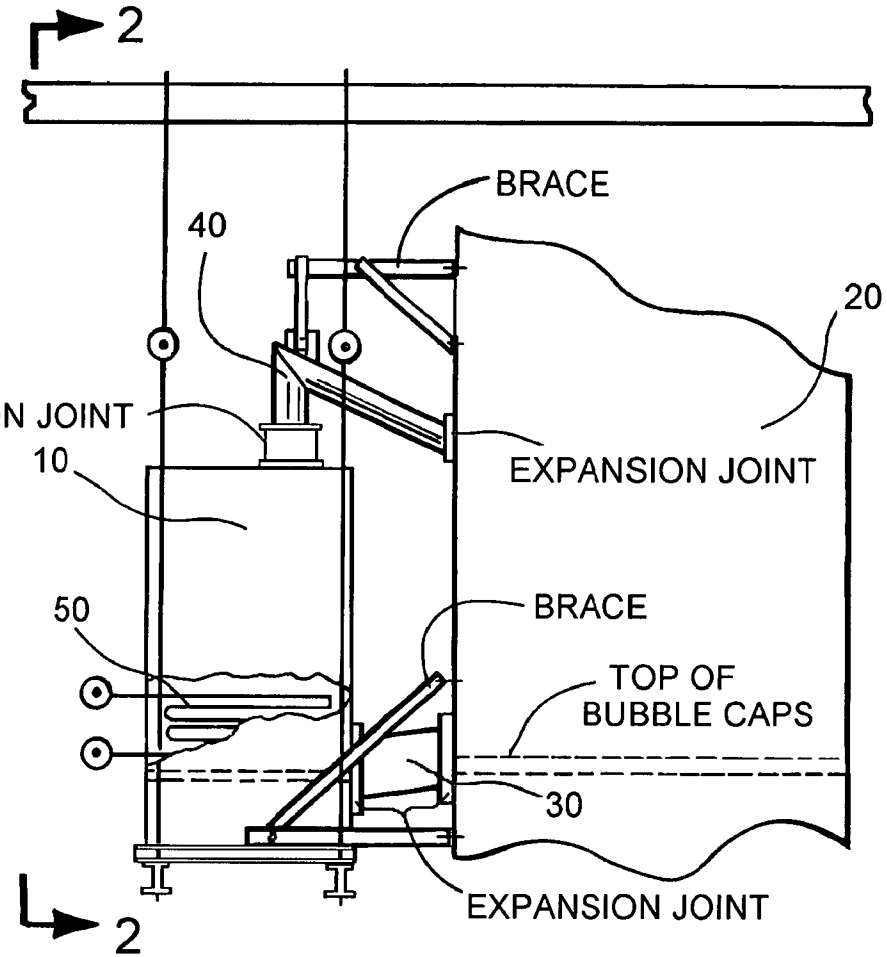
FIG. 1 PRIOR ART
FIG. 1 is a schematic, sectional side view of a known fluidized bed ash cooler having a refractory-lined wall enclosure.
Figure 2:
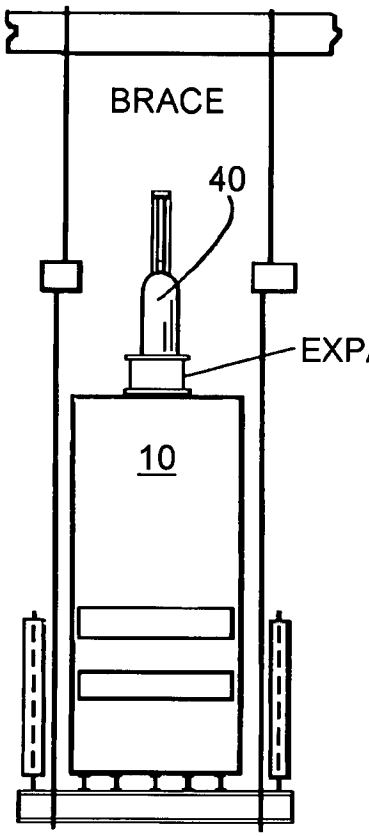
FIG. 2 PRIOR ART
FIG. 2 is a front view of the fluidized bed ash cooler of FIG. 1, viewed in the direction of arrows 2-2 of FIG. 1.
Figure 3:
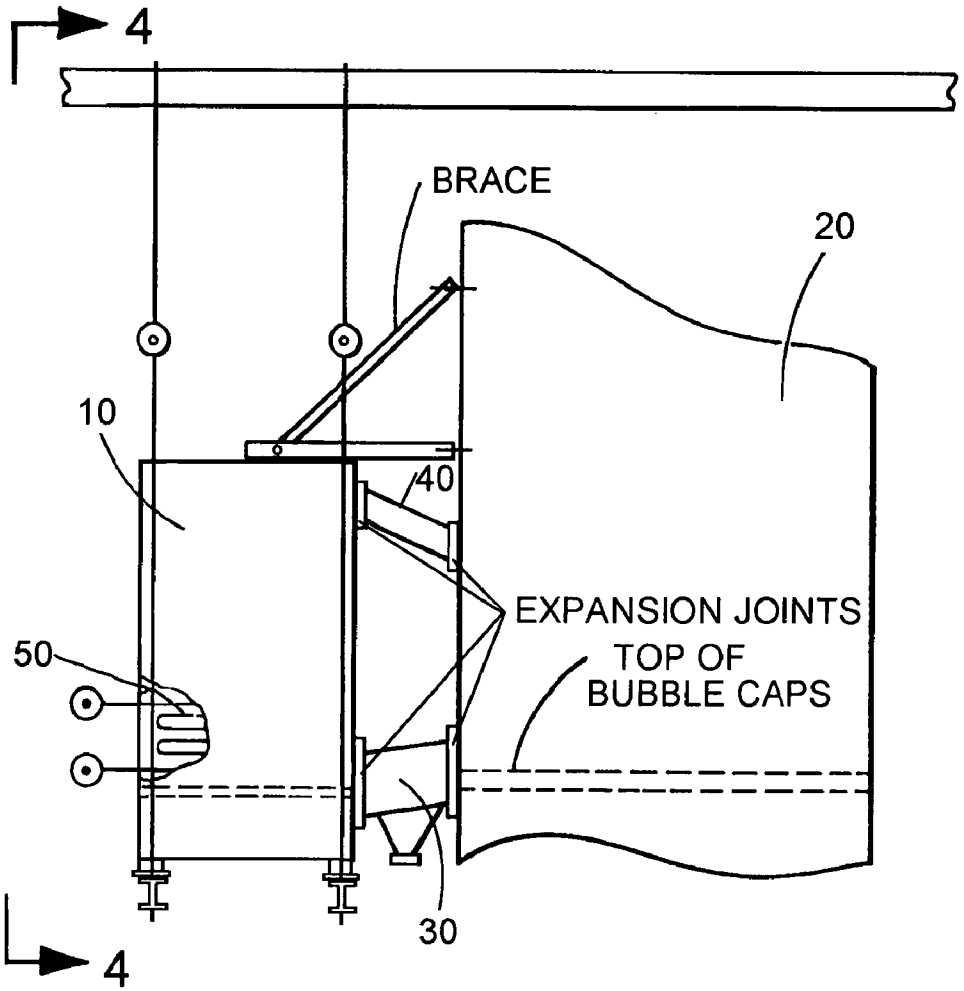
FIG. 3 PRIOR ART
FIG. 3 is a schematic sectional side view of another known fluidized bed ash cooler having a fluid-cooled membrane wall enclosure.
Figure 4:
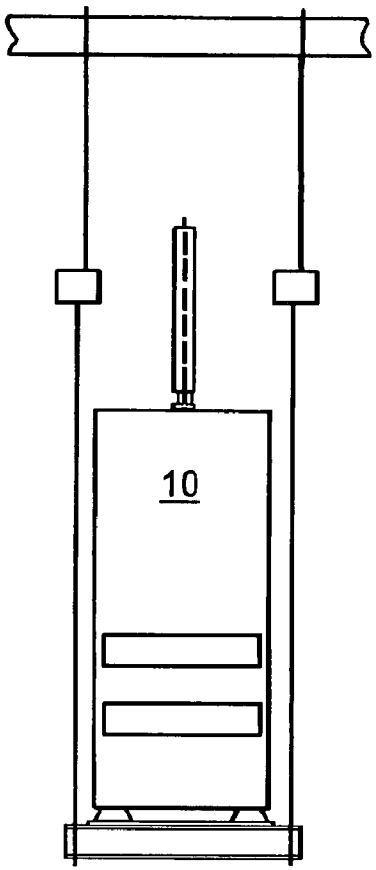
FIG. 4 PRIOR ART
FIG. 4 is a front view of the fluidized bed ash cooler of FIG. 3, viewed in the direction of arrows 4-4 of FIG. 3.

Referring to the drawings generally wherein like reference numerals designate the same or functionally similar elements throughout the several drawings, and to FIGS. 5-9 in particular, there is illustrated a first embodiment of the integrated fluidized bed ash cooler according to the present invention, generally designated 100.

Figure 5:
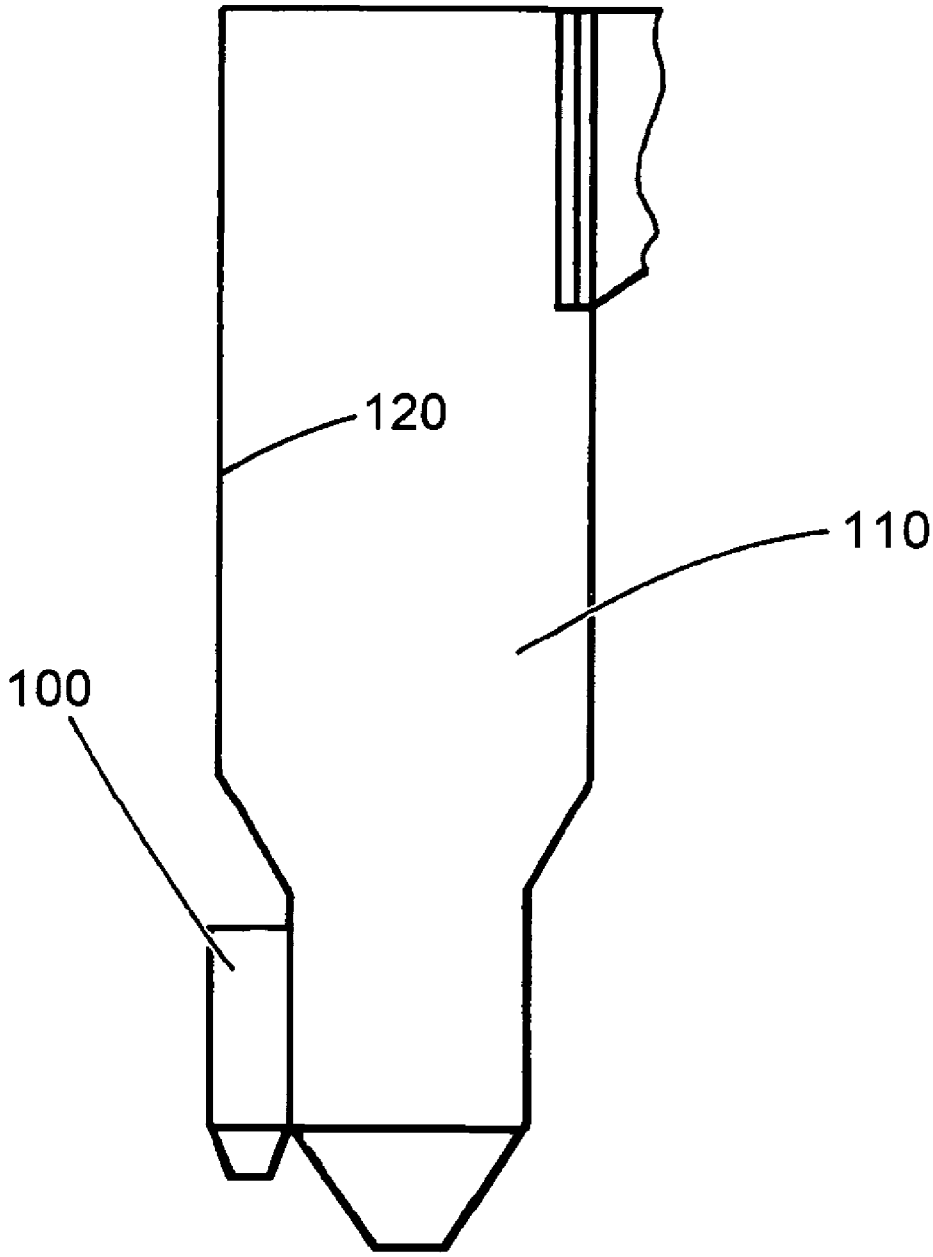
FIG. 5 is a schematic sectional side view of the integrated fluidized bed ash cooler according to the present invention, located adjacent a CFB furnace enclosure.
Figure 6:
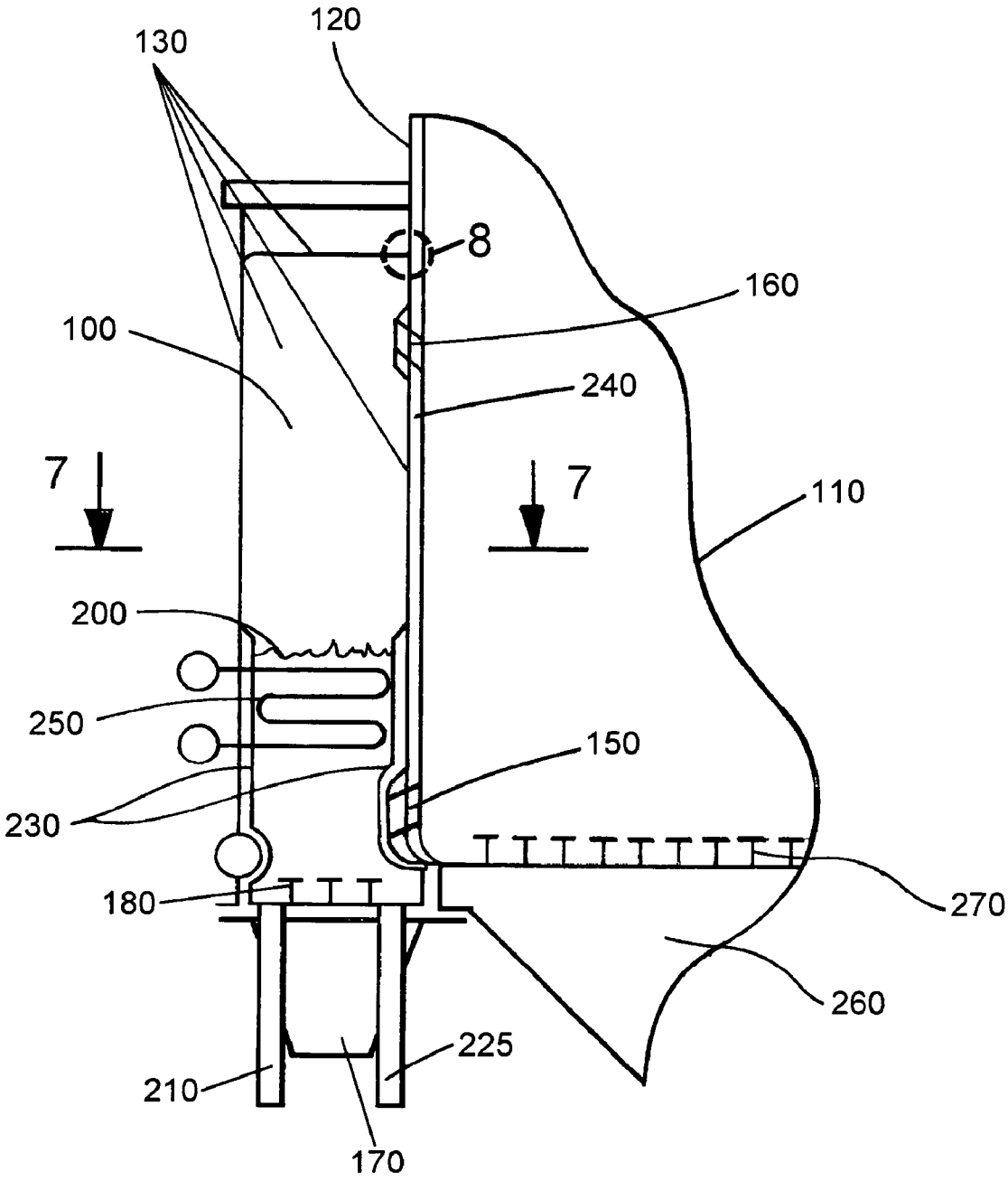
FIG. 6 is a sectional side view of the integrated fluidized bed ash cooler according to the present invention, viewed in the direction of arrows 6-6 of FIG. 7.

As illustrated in FIGS. 5 and 6, the integrated fluidized bed ash cooler 100 is provided as an integral part of a circulating fluidized bed (CFB) furnace 110 having furnace walls 120. As shown in FIG. 6, the ash cooler 100 is preferably formed of membrane tube wall panels 130 one of which is a part of one of the furnace walls 120. While it is most likely that such membrane wall construction would be employed for both the fluidized bed furnace 110 and the fluidized bed ash cooler 100, it is possible that an uncooled enclosure wall construction could be employed for both the ash cooler 100 and the fluidized bed furnace 110. The principles of the present invention are applicable to such constructions as well.

In a preferred embodiment, all of the furnace walls 120 and membrane tube wall panels 130 are included in the furnace 110 circulation circuits. There are at least two openings in the furnace wall 120 which is a common wall shared with the ash cooler 100. A lower inlet opening 150 provides means for conveying or transferring hot ash from the CFB furnace 110 into the ash cooler 100. An upper outlet opening 160 provides means for conveying heated air (or other fluidizing and cooling medium) from the ash cooler 100 back into the CFB furnace 110. The fluidizing medium is supplied to the ash cooler 100 from a windbox 170 through fluidizing means such as bubble caps 180. The bubble caps 180 provide the means for fluidizing the solids and the "position" of the fluidizing means is essentially established by the location of the exit holes in the bubble caps which deliver the fluidizing medium into the bed of solids.

According to the present invention, a cooling medium is circulated through the enclosure walls 120 of the fluidized bed furnace 110 and the fluidized bed ash cooler 100. The flow of cooling medium through the common wall is predominantly upflow and, in one embodiment, the flow of cooling medium through the remaining enclosure walls 130 of the fluidized bed cooler 100 is predominantly downflow. Advantageously, the cooling medium is at least one of water and a mixture of water and steam. As described above, the common wall is provided with two openings, the upper opening 160 for discharging hot fluidizing medium from the fluidized bed ash cooler 100 into the fluidized bed furnace 110, and a lower opening 150 for conveying bottom ash solids from the fluidized bed furnace 110 into the fluidized bed ash cooler 100.

Figure 7:
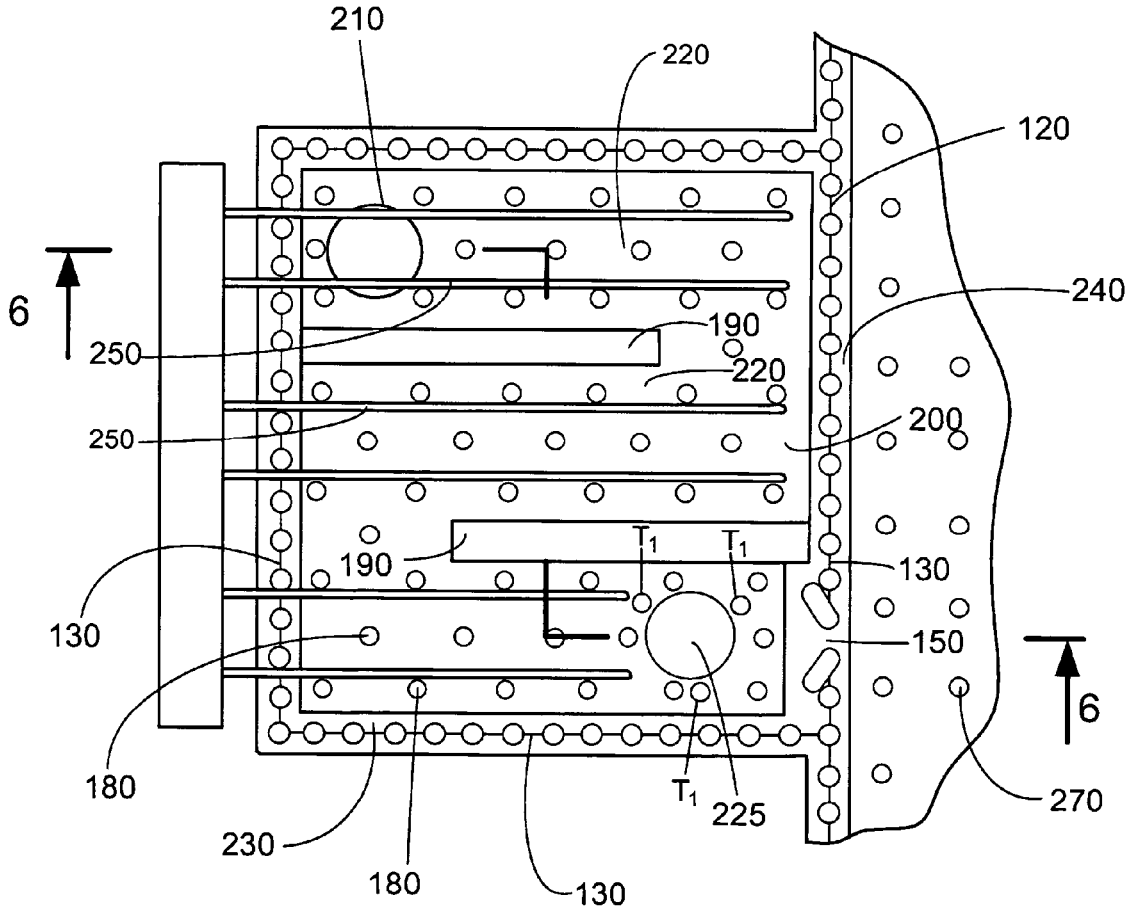
FIG. 7 is a cross-sectional plan view of the integrated fluidized bed ash cooler of FIG. 6, viewed in the direction of arrows 7-7 of FIG. 6.

As shown in FIG. 7, baffles 190 immersed within a fluidized bed 200 of ash cause the fluidized ash particles to proceed along a tortuous path from the lower inlet opening 150 to a discharge opening 210. This helps to ensure adequate residence time for cooling of all ash particles provided into the ash cooler 100. The bottom ash discharge rate from opening 210 is controlled by a feeder means (illustrated as 215 in FIG. 10), such as a screw conveyor, which generally runs continuously as needed for removal of bottom ash from the furnace 110. If desired, the windbox 170 (not shown in FIG. 7) can be partitioned to provide means for separately controlling the flow of the fluidizing medium into different sections of the fluidized bed 200 of ash particles as those sections may be defined by the baffles 190. In addition, if desired, different fluidizing mediums can be supplied to different sections of the fluidized bed 200; e.g., flue gas may be provided to a particular section or sections 220 located adjacent to the lower inlet opening 150, while air may be advantageously provided to other sections of the fluidized bed 200. This flexibility allows prevention of combustion of unburned carbon in the bottom ash that might otherwise occur, especially in the case of firing low reactive fuels such as anthracite. Other means for preventing high temperatures in the first section (where combustion is possible) can include spraying water into the fluidized bed in this section. Spraying water into the fluidized bed, in general, may be utilized for lowering the bed temperature down to a desired level, and may be particularly useful in connection with oversize bottom ash material being discharged from the first section through opening 225.

Figure 8:
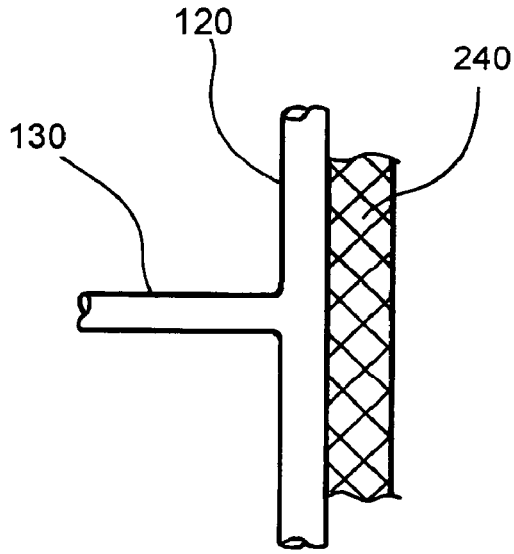
FIG. 8 is an enlarged view of the circled portion designated 8 of FIG. 6 and illustrates an upper junction of the integrated fluidized bed ash cooler of FIG. 6 with a front wall of the CFB furnace enclosure.
Figure 9:
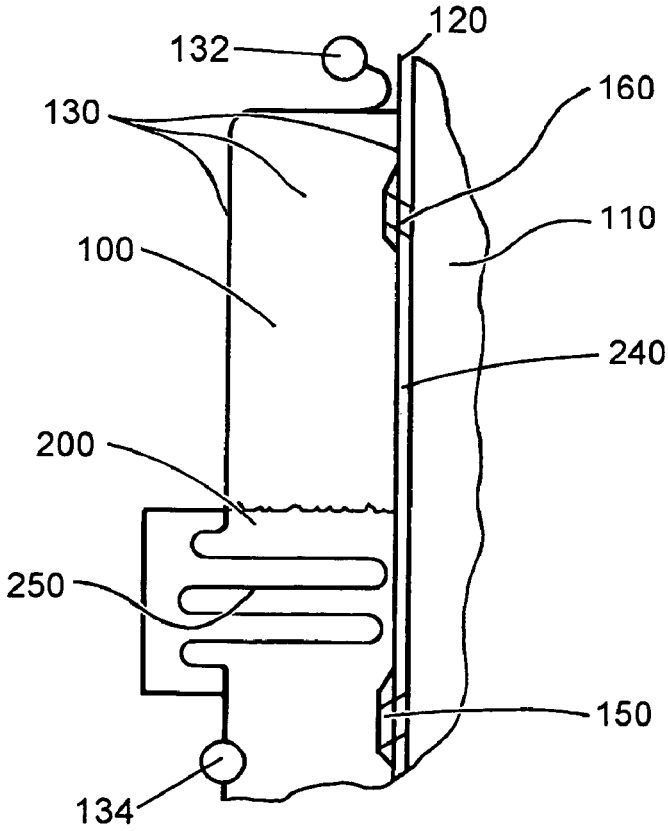
FIG. 9 is a close-up, sectional side view of a variation of the first embodiment of the integrated fluidized bed ash cooler of FIG. 6, wherein at least some of the tube banks immersed within the fluidized bed contained within the integrated fluidized bed ash cooler are incorporated into the CFB boiler circulation circuits.

The height of the fluidized bed 200 at any given moment is such as to compensate a pressure differential between the openings 150 and 160 which, in turn, is determined by the pressure profile within the CFB furnace 110. The membrane tube wall panels 130 may be partially or completely coated with refractory 230 to prevent erosion. Refractory 240 protects the CFB furnace walls 120 in the lower portion of the CFB furnace 110. If desired, tube banks 250 supplied with a cooling medium could be provided and immersed within the fluidized bed 200 to provide for additional heat absorption from the hot ash. The cooling medium conveyed through some or all of the tube banks 250 could be supplied from different sources, such as boiler feed water, water or steam from an external source (with respect to the CFB furnace or boiler circulation circuits). One of the preferred embodiments of the present invention is to incorporate at least some of the tube banks 250 into the CFB boiler circulation circuits, as illustrated in FIGS. 8 and 9. As shown in FIG. 8, some of the tubes forming the membrane tube wall panels 130 of the ash cooler 100 may be combined at a "tee" section with the tubes forming the CFB furnace walls 120. As shown in FIG. 9, some of the tubes forming the ash cooler 100 membrane tube wall panels 130 may be part of a separate fluid circuit where the cooling medium may be provided via an inlet header 132, flowing through the tubes in the panels 130 to an outlet header 134. Advantageously, the flow in this instance would be predominantly downwardly, the inlet header 132 being located at a higher elevation than the outlet header 134.

As illustrated in FIGS. 6 and 7, solids within the CFB furnace 110 are vigorously fluidized with air supplied from a windbox 260 through bubble caps 270. Ash particles are also fluidized in the ash cooler 100, and the two fluidized beds are separated by the common wall 120. Proper size and geometry of the lower inlet opening 150 will ensure a reliable flow of bottom ash particles from the CFB furnace 110 to the ash cooler 100. Shutting down flow of the fluidizing medium provided to the section 220 within the ash cooler 100 adjacent to the lower inlet opening 150 will effectively stop solids flowing from the CFB furnace 110 into the ash cooler 100.

As is known to those skilled in the CFB arts, a fuel fired in the CFB may contain rocks or form agglomerates during combustion. These rocks or agglomerates can be reliably fluidized in a CFB furnace, because of its comparatively high gas velocity. However, the velocity of the fluidizing medium in an ash cooler, which would be typically several times less than that seen in a CFB furnace, may be not sufficient for reliable fluidization of those rocks or agglomerates. In such a case, accumulation of coarse fractions in the ash cooler will occur, resulting in its pluggage and eventual shutdown.

Figure 10:
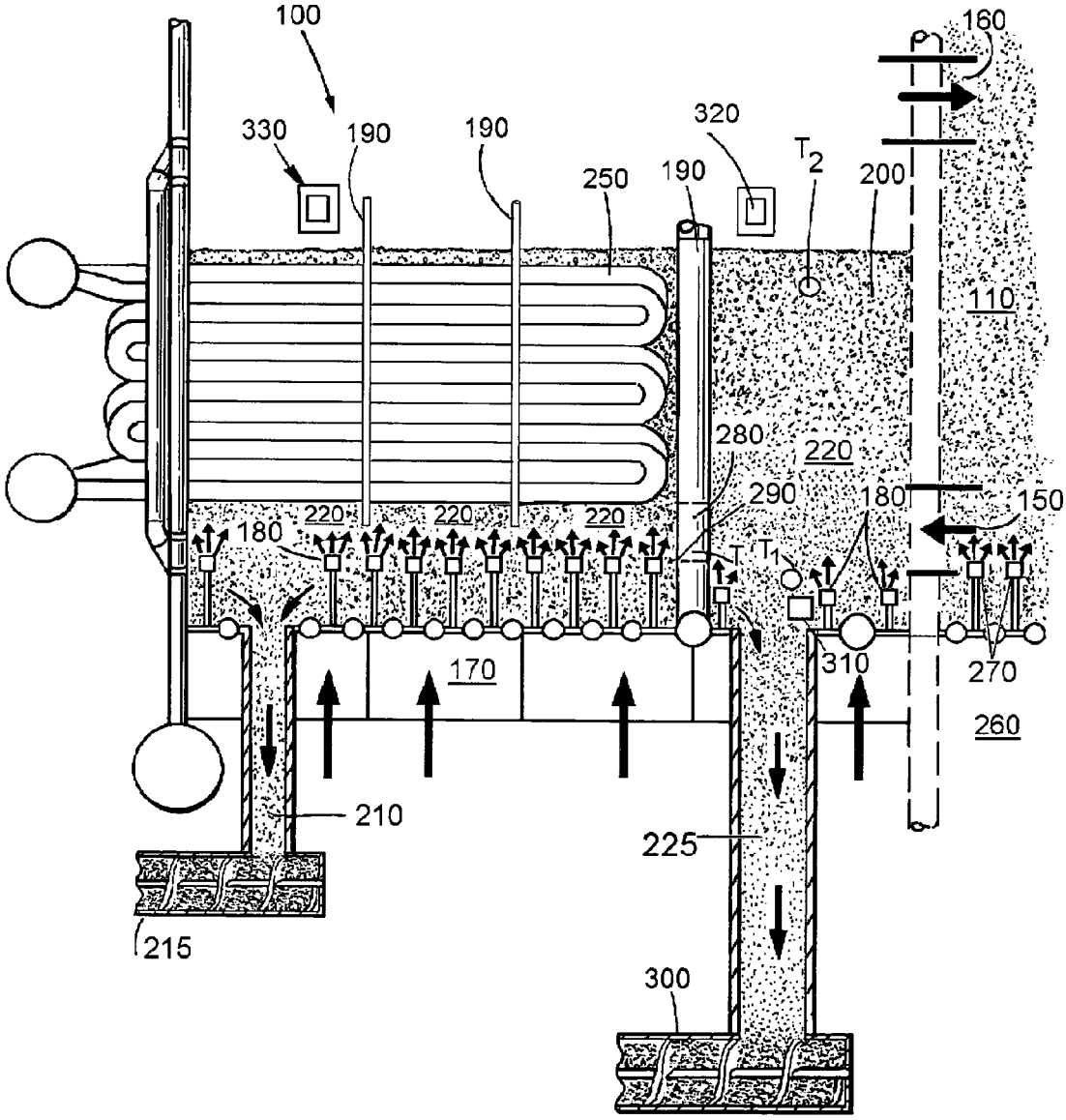
FIG. 10 is a sectional side view of a second embodiment of the integrated fluidized bed ash cooler according to the present invention.

In order to avoid this problem, and as illustrated in FIG. 10 according to the present invention, a first section 220 adjacent to the lower inlet opening 150 is equipped with its own solids discharge opening 225. Coarse fractions such as rocks or agglomerates will tend to sink to the bottom of this first section 220 from where they will be timely discharged without having to move along and through the ash cooler 100 to the discharge opening 210 and eventually removed by feeder means 215. Since the throughput of the coarse particles is relatively small compared to the total flow rate of the bottom ash, the coarse ash particles will normally be sufficiently cooled during their movement downward along the bubble caps 180 of the first section 220 for conveyance by the feeder means 215. However, if necessary, additional cooling can be provided by other means such as water spray nozzle means 310 which can be used to spray water into these coarse ash particles before they are discharged through discharge opening 225 and conveyed away via feeder means 300. Water spray nozzle means 320 may also be provided to cool the bottom ash in the first section 220. Finally, water spray nozzle means 330 may also be provided for supplemental cooling of the bottom ash before it is discharged through discharge opening 210 and conveyed away via feeder means 215.

As shown therein, an important feature of the present invention involves creating what is termed a "threshold" T between the first section 220 and the following sections 220 within the fluidized bed ash cooler 100 for preventing coarse bottom ash solids from passing from the first section 220 into those following, downstream sections. Thus, at least two fluidized bed sections are positioned in series along a bottom ash solids flow path, each section 220 containing fluidizing means, such as an array of bubble caps 180 forming a distribution grid, for supplying a fluidizing medium into the bottom ash solids. The first section 220 along the solids path is separated from a following section by the threshold T. In one embodiment, the threshold is formed by a wall (such as partition 190) which has an aperture 280 and an edge 290 located above the fluidizing means of the first section 220. In another embodiment the function of the threshold can be provided by positioning the fluidizing means 180 in the first section 220 at a lower elevation than an elevation of fluidizing means 180 in the following section 220.

The first section 220 contains means, such as thermocouples, for measuring a bed temperature both in the vicinity of the fluidizing means (as at $T_1$) and at a higher elevation (as at $T_2$) within the fluidized bed 200. When the coarse material begins to accumulate in the first section 220, it first fills the volume below the threshold level, and the portion of the 200 bed in this volume stops being fluidized, becoming stagnant and which no longer mixes with the fluidized material above. This stagnant material is being cooled by the fluidizing medium flowing up from the fluidizing means 180, creating a temperature difference between the stagnant material and the fluidized material above. This temperature difference ($T_2$–$T_1$) is then detected by the thermocouple means for measuring the bed temperature and signals the accumulation of the coarse material in the lower part of the first section 220. This signal triggers the discharge of the bed material from the first section 220 by activating feeder means 300, such as a screw conveyor. The discharge continues until the elimination of the temperature difference, which is indicative of fluidization of the entire bed of material in the first section 220.

Another way to enhance separation of the coarse particles in the first section 220, as well as improving the overall reliability of the ash cooler 100, is by maintaining the fluidizing velocity in this first section 220 at a lower value than the fluidization velocity maintained in following (downstream) sections 220 of the ash cooler 100. The higher the fluidization velocity, the higher the likelihood that particles of a given size will be fluidized, as opposed to sinking. Therefore, the ash particles which did not sink in the first section 220 will be reliably fluidized in the other downstream sections 220 of the ash cooler 100.

Fluidizing medium is supplied to every section 220 of the ash cooler 100 at a controlled rate to maintain a desired fluidization velocity in each section. The mass flow rate to a given ash cooler section 220 is automatically adjusted based upon the bed temperature in that section in order to maintain a pre-set fluidization velocity. For example, an increase in the bed temperature in a section will result in a reduction of the fluidizing medium mass flow rate to that section in order to compensate for the increased specific volume of the fluidizing medium.

It will thus be appreciated that the integrated fluidized bed ash cooler according to the present invention has several advantages over the ash cooler designs of the prior art. For example, if the ash cooler 100 enclosure walls are made of membrane tube wall panels which are incorporated into the CFB boiler circulation circuits, as are all the panels forming the CFB furnace walls, the wall temperature and thermal expansion of the ash cooler 100 always follows that of the CFB furnace. This eliminates a need for high temperature expansion joints on the conduits between the ash cooler 100 and the CFB furnace, simplifying the design, and reducing maintenance and improving reliability of the ash cooler 100. By incorporating a part of the CFB furnace wall as part of the ash cooler 100 enclosure, the overall size and weight of both the ash cooler 100 and its support structure is greatly simplified, resulting in further cost reductions. Using a simple opening instead of the prior art air-assisted conduit for transferring ash from the CFB furnace into the ash cooler 100 also improves reliability and reduces maintenance of the ash cooler 100. Cooling and removing bottom ash from fuels containing rocks or forming agglomerates can be reliably performed by discharging coarser particles from the first section of the ash cooler 100. Separation of the coarser particles can be enhanced by maintaining a reduced velocity of the fluidizing medium in the first section of the ash cooler 100.

While specific embodiments of the invention have been shown and described in detail to illustrate the application of the principles of the invention, those skilled in the art will appreciate that changes may be made in the form of the invention covered by the following claims without departing from such principles. For example, the present invention may be applied to new construction involving circulating fluidized bed reactors or combustors, or to the replacement, repair or modification of existing circulating fluidized bed reactors or combustors. In some embodiments of the invention, certain features of the invention may sometimes be used to advantage without a corresponding use of the other features. Accordingly, all such changes and embodiments properly fall within the scope of the following claims.

We claim:

1. A fluidized bed ash cooler for cooling bottom ash solids from a fluidized bed furnace, comprising:

at least two fluidized bed sections positioned in series along a solids flow path, each section containing fluidizing means, the first section along the solids path being separated from a following section with a threshold, the first section containing thermocouple means for measuring a bed temperature $T_1$ in the vicinity of the fluidizing means and at a higher elevation $T_2$ within the fluidized bed, and means for removing oversized bed material from the first section when a temperature difference $(T_2-T_1)$ between stagnant bed material and fluidized bed material above, indicative of an accumulation of bed material in a lower part of the first section, is detected by the thermocouple means.

2. The fluidized bed ash cooler according to claim 1, wherein the threshold is formed by a wall which has an upper edge located above the fluidizing means of the first section.

3. The fluidized bed ash cooler according to claim 1, wherein the threshold is formed by positioning the fluidizing means in the first section at a lower elevation than an elevation of fluidizing means in the following section.

4. The fluidized bed ash cooler according to claim 1, wherein the first section contains no heat absorbing surface immersed in the fluidized bed.

5. The fluidized bed ash cooler according to claim 1, comprising means for lowering a bed temperature of a section when said temperature exceeds a preset value.

6. The fluidized bed ash cooler according to claim 5, wherein the means for lowering the bed temperature comprises means for spraying water into the fluidized bed.

7. The fluidized bed ash cooler according to claim 1, comprising means for maintaining a desired fluidization velocity of fluidizing medium in each section.

8. The fluidized bed ash cooler according to claim 1, comprising a partitioned windbox for separately controlling the flow of fluidizing medium into different sections of the fluidized bed for maintaining a lower fluidization velocity in the first section relative to a fluidization velocity in following sections.

9. In combination, a fluidized bed furnace having enclosure walls and a fluidized bed ash cooler for cooling bottom ash solids from the fluidized bed furnace, the fluidized bed furnace and the ash cooler sharing a common wall with each other, the fluidized bed ash cooler comprising:

at least two fluidized bed sections positioned in series along a solids flow path, each section containing fluidizing means, the first section along the solids path being separated from a following section with a threshold, the first section containing thermocouple means for measuring the solids temperature $T_1$ in the vicinity of the fluidizing means and at a higher elevation $T_2$ within the fluidized bed, and means for removing oversized bed material from the first section when a temperature difference $(T_2-T_1)$ between stagnant bed material and fluidized bed material above, indicative of an accumulation of bed material in a lower part of the first section, is detected by the thermocouple means.

10. The combination according to claim 9, wherein enclosure walls of the fluidized bed cooler and of the fluidized bed furnace are made of membrane tube wall panels.

11. The combination according to claim 10, wherein a cooling medium is circulated through the enclosure walls of the fluidized bed furnace and the fluidized bed ash cooler, and wherein the flow of cooling medium through the common wall is predominantly upflow and the flow of cooling medium through the remaining enclosure walls of the fluidized bed cooler is predominantly downflow.

12. The combination according to claim 11, wherein the cooling medium is at least one of water and a mixture of water and steam.

13. The combination according to claim 9, wherein the common wall is provided with two openings, an upper opening for discharging hot fluidizing medium from the fluidized bed ash cooler into the fluidized bed furnace, and a lower opening for conveying bottom ash solids from the fluidized bed furnace into the fluidized bed ash cooler.

* * * * *